United States Patent [19]

Windle

[11] 3,938,452

[45] Feb. 17, 1976

[54] ADJUSTABLE POINT LOOPING TOOL FOR RUG MAKING

[76] Inventor: Michael J. Windle, 45131 28th St. E., Lancaster, Calif. 93534

[22] Filed: Aug. 16, 1974

[21] Appl. No.: 497,920

[52] U.S. Cl. ..... 112/80; 28/4 N; 69/20; 139/380; 223/102; 223/104

[51] Int. Cl.[2] ..... D05C 15/06

[58] Field of Search ..... 112/79.5, 80, 169, 170, 112/171, 266; 223/104, 102; 69/20; 12/103; 32/52–56; 28/4 N; 139/380

[56] References Cited

UNITED STATES PATENTS

| | | | |
|---|---|---|---|
| 1,912,977 | 6/1933 | Gearhart | 112/80 |
| 3,240,176 | 3/1966 | Morrison | 112/80 |

*Primary Examiner*—Werner H. Schroeder
*Assistant Examiner*—Conrad L. Berman

[57] ABSTRACT

A rug pointer for looping material-yarn through the apertures of backing in checkerboard pattern, and comprised generally of a manipulatable body with an adjustably extended probe and a retractile stop; the probe having a concaved notch at its lowermost terminal end adjustable to project a determined distance from the lowermost terminal end of the body; the stop having a stop shoulder and points depending therefrom in spaced relation to the probe to engage over a member of the backing to lock the yarn in position for the full extension of the loop being formed by projection of the probe with the lowermost terminal end of the body stopped against the back of the loop thus formed.

22 Claims, 5 Drawing Figures

ADJUSTABLE POINT LOOPING TOOL FOR RUG MAKING

BACKGROUND

Hooked rugs and the like, such as needle point rugs with which this invention is particularly concerned are built upon a backing having apertures through which loops of yarn are forced by a needle. These rug pointing needles take various forms and porportions and have been threaded in many ways, whereby the point of the needle precedes the yarn which it draws through successive apertures. Such needles must be employed in various sizes so as to accommodate different yarns, and they must be constantly threaded and rethreaded so as to change yarn color etc. And, such needles do not in themselves limit or control the depth of looping, and additional apparatus must be employed for determining the height of the pile. Since creativeness is sought for in building of such rugs, facility of change and selective use of yarns and the adjustment of looping is sought for and accomplished as an object of this invention. With the present invention, yarns can be selectively changed as desired without threading as is the case with prior art needles, and the looping tool or pointer of the present invention can be adjusted and several such pointers used in drawing a pattern of loops through a backing and thereby sculpturing the rug pile.

The looping tool or pointer hereinafter described has utility in the making of rugs, chair cushion covers, various types of pads and decorative hangings; said tool being manipulated by the user who holds the same in the manner of a writing pen or pencil. The manipulated tool is engaged with the selected yarn that is placed over the backing, and the desired loops are drawn successively through the apertures in the backing by repeated downward or forward strokes which project the tool and loops of yarn through said backing. The depth or extent of loop penetration is adjustable within the tool per se, and unlike the prior art needles it does not require threading. The backing comprised of a checkerboard of apertures is available as a commercial product, with mesh dimensions as may be required.

The pointer of the present invention utilizes yarns and like materials for the building of rugs upon backings of mesh that provide apertures through which loops of the material are forced by the pointer. The usual device of this type requires threading of a needle or of an associated apparatus; it being an object of this invention to eliminate associated apparatus and the threading. With the present invention, a length of yarn is simply manipulated and placed in position and engaged by the pointer to be forced into position, and all to the end that material changes (yarn color, etc.) can be made with facility and without delay.

The usual pile controlling apparatus of such devices is complicated and cumbersome, and some devices control pile depth with the selected use of different needles and other tools such as screw drivers or awls, pliers, etc. In any case, complexity is to be avoided and the requirement of needle selection eliminated; it being an object of this invention to provide a pointer which is self sufficient to accommodate various materials without threading and adjustable as to depth of pile. With the present invention, any material or yarn capable of being forced through the backing apertures is accommodated by the pointer, and the length of the loops forced through the apertures by the pointer is adjustable so as to control the depth of pile.

It is a general object of this invention to provide a tool for manipulation by the user or artisan to force loops of material such as yarn through a backing mesh comprised of a checkerboard of adjacent apertures. It is a primary object to provide a probe that forces loops of the material-yarn through successive apertures, and a secondary and highly utilitarian object to adjustably control the extent of penetration of the loops to determine the ultimate depth of pile. With the present invention, there is a body for the convenient manipulation of the user and from which a probe projects an adjusted distance, and there is a depressible stop limited in its projection by the probe and engageable with the material to hold the same while a loop is extended by the probe. Accordingly, it is another object of this invention to provide a practical combination of the body, probe and stop by incorporating therewith certain other features as will be hereinafter described.

SUMMARY OF THE INVENTION

The pointer is a tool adapted to be manipulated by the user or artisan in creative designs applied to the building of rugs and the like from yarn materials applied to a backing in the form of a multiplicity of loops forced and extended through apertures in said backing. The backing is a uniform mesh of crossed or woven members, of substantial body and of planar form having flexibility. The mesh is a checkerboard of square apertures varying in dimension dependant upon the yarn to be anchored therein; and the yarn can vary widely in texture, construction and color dependent upon requirements of the artisan and the effect desired. A general object is to draw successive loops of yarn through adjacent apertures, working forwardly and to the left or right, as patterns and designs are developed loop by loop.

In accordance with this invention, the pointer is provided in the form of a tool having a body B for convenient manipulation, a probe P for engageably extending loops of yarn through each aperture of the backing, a stop S for securing the entry leg of each loop when drawing the exit leg thereof through the backing aperture, adjustment means A positioning the probe P relative to the body B, limit means L determining projection of the stop S relative to the probe P, spring means C projecting the stop S into engagement with limit means L, and guide means G rotatably orienting the stop S within the body B. In practice, the aforementioned elements of the pointer are plastic parts, with the exception of the spring means C that is a conventional metal spring. The assembled tool is of pencil-shape, an elongated assembly presenting a smooth unobstructed exterior with the active elements S and P exposed at one end and the adjustment means A exposed at the other end.

DRAWINGS

The various objects and features of this invention will be fully understood from the following detailed description of the typical preferred forms and applications thereof, throughout which description reference is made to the accompanying drawings, in which.

PREFERRED EMBODIMENT

Figure 1:
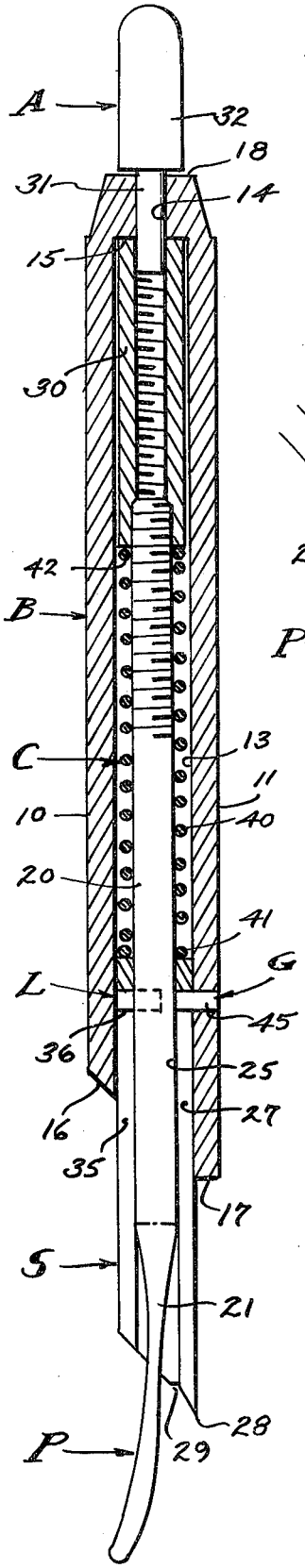
FIG. 1 is a longitudinal sectional view of the pointer of the present invention.

The body B is an elongated tubular element open at its opposite ends to exposure the elements S and P at its lowermost end and to exposure the element A at its uppermost end. In accordance with this invention the body B has a front and a back, the former being pointed at 10 for identification and the latter being flat at 11. As shown, the body is polygonal and preferably triangular in cross section, with converging sides 12 for a convenient finger grip in the hand of the user. The bore 13 is also triangular, though it can be cylindrical, there being a reduced bore at 14 at the uppermost end that presents a shoulder 15. The lowermost front sides 12 are truncated at 16 for better exposure of the exit leg of the loops as they are formed.

The probe P is an elongated shaft element that rides within the stop S and positioned by the adjustment means A. The shaft 20 thereof is of straight cylinder form with its upper end threaded and its lower end 21 transversely flattened and bent or turned toward the front of the body as it projects downward and forwardly. The lowermost transverse end 21 is concaved so as to present a notch centered therewith and adapted to guide the yarn centrally thereover. As shown, the transverse end 21 and its concaved configuration is well rounded so as to pass the yarn freely. In accordance with the invention, the lowermost concaved portion of member P projects a substantial distance from the lower terminal end 17 of the body B, said end being disposed in a plane normal to the longitudinal axis of the tool.

Figure 2:
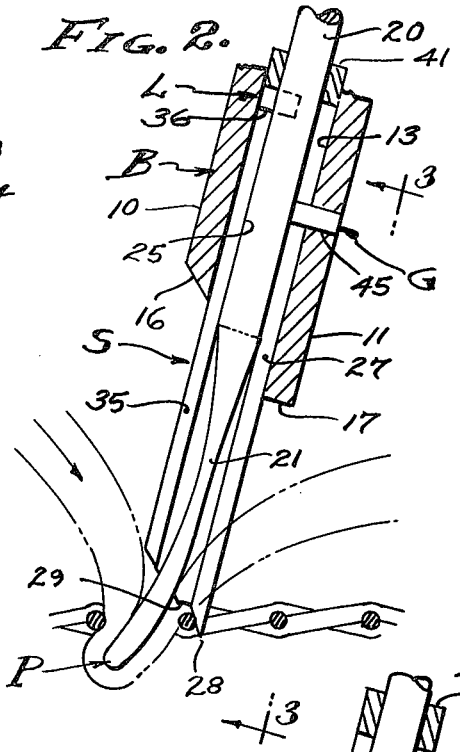
FIG. 2 is an enlarged sectional view of the lower portion of the pointer illustrating the initial projection of a loop of yarn through a backing.
Figure 3:
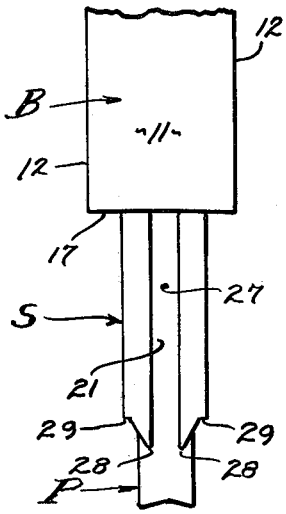
FIG. 3 is a side sectional view taken as indicated by line 3—3 on FIG. 2.
Figure 4:
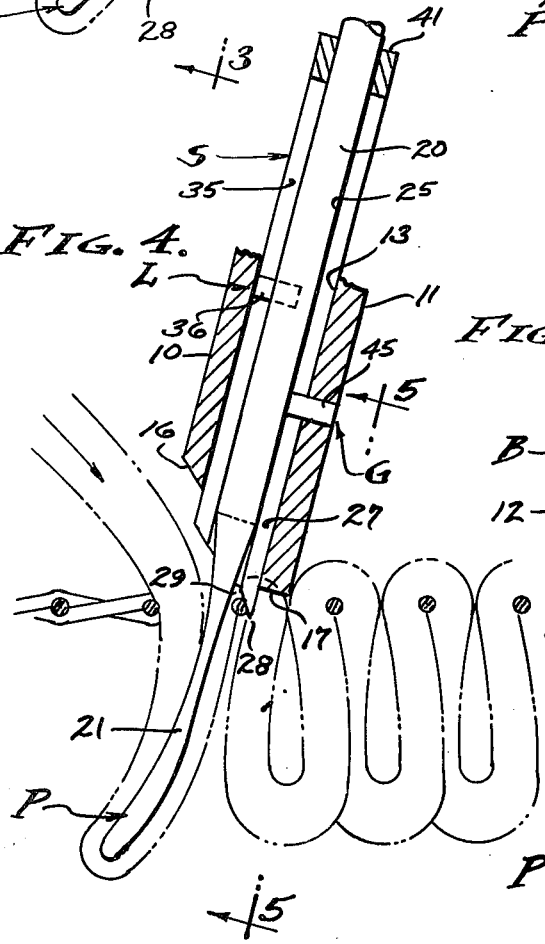
FIG. 4 is a view similar to FIG. 2 depicting a fully projected loop of yarn through the backing.
Figure 5:
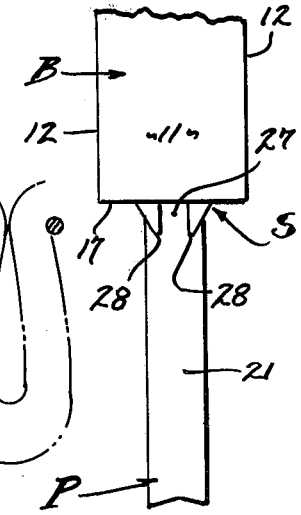
FIG. 5 is a side sectional view taken as indicated by line 5—5 on FIG. 4.

The stop S is an elongated cylindrical sleeve element with a bore 25 therethrough to slideably pass the shaft 20 of probe P. The exterior of the stop can conform to the interior of the body B to freely slide therein, and is preferably round in cross section so as to slideably engage the three inner faces within said body. In accordance with this invention, the stop S is adapted to anchor the entry leg of the loop of yarn as initially depicted in FIGS. 2–3, and to continue to do so as depicted in FIGS. 4–5. Accordingly, the lowermost end portion of the stop is bifurcated into separate sides that will embrace the entry leg of yarn drawn therebetween as best illustrated in FIG. 3, there being a channel 27 centered at the rear of and extending longitudinally of the stop cylinder to open at its lowermost extremity to form a pair of spaced points 28 below a pair of stop shoulders 29 disposed in a common plane between said points and the rear side 22 of the probe P. The spaced points 28 that depend below the spaced shoulders 29 are significant as best illustrated in FIGS. 2 and 4, to bear upon the rearmost cross member of the mesh or webbed backing; in a manner to press the yarn between said points and the opposing rear side of the probe. The points 28 are upwardly divergent so as to have a cam action, and the lower flattened and curved portion of the probe is free within the stop cylinder to deflect forwardly so as to accommodate various diameters of yarn pressed there against by said cam action of the points 28. Thus, the entry leg of the yarn becomes locked and anchored in place when engaged as shown in FIGS. 2–5.

A feature of this invention is the adjustment means A that positions the probe P to project a determined distance from terminal end 17 of the body B. This adjustment determines the fully projected extent of the loop of yarn as shown in FIG. 4, when the terminal end 17 of body B stops against the back of the loop. Means A involves an internally threaded nut 30 captured against the shoulder 15 by a spindle 31 held thereto by a shouldered knob 32 engageable with the top end 18 of body B. The spindle 31 is rotatable in the reduced bore 14 and is pressed into the nut 30 to turn the same, so as to extend and/or retract the probe P. Thus, the extended position of the probe P from the lower terminal end 17 of body B is adjustably fixed.

The limit means L is provided to establish a minimal projection of the probe P from the stop shoulders 29 of the stop S, for the purpose of initiating a loop and which diminishes the preceding loop dependent upon the frictional characteristics of the yarn used. In most cases the preceding loop is diminished during the initial entry to a position approximating that shown in FIG. 2, and for this reason the fully extended loop of FIG. 4 is correspondingly projected to excess, thereafter to be correspondingly diminished. As shown, the means L comprises a slot 35 at the front of and extending longitudinally of the stop cylinder, and a pin 36 projecting radially from the probe P and engaged therein. The slot 35 terminates at the uppermost end of the stop cylinder where it is engaged by the pin 36 when the stop S is fully extended relative to the probe P. The slot 35 opens at the lower end of the stop cylinder and consequently the stop S follows the adjusted positioning of the probe P, being free to retract upwardly while the probe remains fixably positioned. Thus, the stop S can retract from the position shown in FIG. 2 to that shown in FIG. 4.

Another feature of this invention is the spring C that projects the stop S to its limited projected positioning as shown in FIGS. 1, 2 and 3. An elongated annulus is provided between the body B and probe shaft 20, the means C being a helical compression spring 40 acting between the normal uppermost end face 41 of the stop cylinder and the normal lowermost end face 42 of the nut 30. Thus, the spring means C yieldingly urges the stop S to the extended position shown in FIG. 1.

Still another feature of this invention is the guide means G that rotatably positions the retractile stop S so that it remains faced toward the front of the tool. The channel 27 formed in the stop cylinder as hereinabove described is extended so as to serve the purpose of this means which includes a key 45 that projects radially inward from the body B to slideably engage in the said channel. The channel 27 terminates at the uppermost end of the stop cylinder where it is engaged by the key 45 when the probe P and stop S are fully extended as shown in FIG. 1. The probe P and stop S are half extended as shown in FIG. 2 (for a comparison), it being understood that they can be fully retracted (not shown). Thus, the stop S can be adjusted to project the stop shoulders 29 to the desired loop determining distance from the terminal end 17 of body B.

From the foregoing it will be seen that the elements of this rug pointer tool are easily manufactured and assembled, that the adjustments thereto are made with facility, and that the extent of each loop drawn through the rug backing can be controlled with exact determination without other aids, and all with freedom to change materials-yarn without threading or re-rigging of a supporting apparatus.

Having described only a typical preferred form and application of my invention, I do not wish to be limited or restricted to the specific details herein set forth, but wish to reserve to myself any modification or variations that may appear to those skilled in the art:

I claim:

1. A pointer for looping yarn in the building of rugs and the like upon backings comprised of a multiplicity of apertures in checkerboard pattern defined by crossed members, and including; an elongated body having a lower terminal end, a probe fixedly positioned to extend from the lower terminal end of the body and having a concaved notch at its lower terminal end spaced from the lower terminal end of the body, a retractile stop normally projected to an extended position with a shoulder positioned intermediate the lower terminal ends of the probe and body respectively, and spring means engaged with and operable between the stop and a face in the body to yieldingly urge the stop to said extended position, whereby said shoulder of the stop is retractile to the lower terminal end of the body when engaged to hold against the entry leg of a loop of yarn while the exit leg of said loop is being fully extended.

2. The rug loop pointer set forth in claim 1 wherein the body is tubular with the probe and stop carried therein to project from the lower terminal end thereof.

3. The rug loop pointer set forth in claim 1 wherein the body is tubular and the probe fixedly positioned therein with the stop in the form of a sleeve slideably engaged over the probe and within the body.

4. The rug loop pointer set forth in claim 1 wherein the body is tubular and the probe a shaft fixedly positioned in the body with the stop in a form of a sleeve slideably engaged over the probe shaft and within the body.

5. The rug loop pointer set forth in claim 1 wherein the body is tubular and the probe a shaft fixedly positioned in the body with the stop in the form of a sleeve slideably engaged over the probe shaft and within the body and with limit means restricting projection of the stop sleeve to said extended position.

6. The rug loop pointer set forth in claim 1 wherein the body is tubular and the probe a shaft fixedly positioned in the body with the stop in the form of a sleeve slideably engaged over the probe shaft and within the body and with a limit means in the form of a pin projecting from the probe shaft and engaged in a slot in the stop sleeve restricting projection of the stop sleeve to said extended position.

7. The rug loop pointer set forth in claim 1 wherein the stop shoulder is adjacent one side of the probe and engageable over a cross member of said backing.

8. The rug loop pointer set forth in claim 1 wherein the stop shoulder is adjacent one side of the probe with a depending point spaced from the probe and engageable over a cross member of said backing.

9. The rug loop pointer set forth in claim 1 wherein the stop shoulder is adjacent one side of the probe with a divergently depending point spaced from the probe and engageable over a cross member to wedge the entry leg of the loop between said member and probe.

10. The rug loop pointer set forth in claim 1, wherein the lower end portion of the probe is flattened, and wherein the stop shoulder is adjacent one side of the probe with a divergently depending point spaced from the probe and engageable over a cross member to wedge the entry leg of the loop between said member and the flattened portion of the probe.

11. An adjustable pointer for looping yarn in the building of rugs and the like upon backings comprised of a multiplicity of apertures in checkerboard pattern defined by crossed members, and including; an elongated body having a lower terminal end, a probe having a concaved notch at its lower terminal end, adjustment means positioning the probe to extend a determined distance from and with its notched lower terminal end spaced from the lower terminal end of the body, a retractile stop normally projected to an extended position with a shoulder positioned intermediate the lower terminal ends of the probe and body respectively, and spring means engaged with and operable between the stop and a face in the body to yieldingly urge the stop to said extended position, whereby said shoulder of the stop is retractile to the lower terminal end of the body when engaged to hold against the entry leg of a loop of yarn while the exit leg of said loop is being fully extended.

12. The adjustable rug loop pointer set forth in claim 11 wherein the body is tubular with the probe and stop and adjustment means carried therein to project from the terminal end thereof.

13. The adjustable rug loop pointer set forth in claim 11 wherein the body is tubular and the probe positioned therein by said adjustment means with the stop in the form of a sleeve slideably engaged over the probe and within said body.

14. The adjustable rug loop pointer set forth in claim 11, wherein the body is tubular, and wherein the adjustment means comprises a rotatable nut remote from said lower terminal end of the body, the probe being threadedly engaged in the nut and positioned thereby to extend said determined distance from the lower terminal end of the body.

15. The adjustable rug loop pointer set forth in claim 11, wherein the body is tubular, and wherein the adjustment means comprises a rotatable nut captured to turn in the end of the body remote from said lower terminal end thereof, the probe being threadedly engaged in the nut and positioned thereby to extend said determined distance from the lower terminal end of the body.

16. The adjustable rug loop pointer set forth in claim 11, wherein the body is tubular, wherein the adjustment means comprises a rotatable nut captured to turn in the end of the body remote from said lower terminal end thereof, the probe being threadedly engaged in the nut and positioned thereby to extend said determined distance from the lower terminal end of the body, and wherein the stop is in the form of a cylinder slideably engaged over the probe and within said body.

17. The adjustable rug loop pointer set forth in claim 11, wherein the body is tubular, wherein the adjustment means comprises a rotatable nut remote from the lower terminal end of the body, the probe being a shaft threadedly engaged in the nut and postioned thereby to extend said determined distance from the lower end of the body, and wherein the stop is in the form of a sleeve slideably engaged over the probe shaft and within the body.

18. The adjustable rug loop pointer set forth in claim 11, wherein the body is tubular, wherein the adjustment means comprises a rotatable nut captured to turn in the end of the body remote from said lower terminal end thereof, the probe being a shaft threadedly engaged in the nut and positioned thereby to extend said determined distance from the lower terminal end of the body, and wherein the stop is in the form of a sleeve slideably engaged over the probe shaft and within the body and with limit means restricting projection of the stop sleeve to said extended position.

19. The adjustable rug loop pointer set forth in claim 11, wherein the body is tubular, wherein the adjustment means comprises a rotatable nut captured to turn in the end of the body remote from said lower terminal end, the probe being a shaft threadedly engaged in the nut and positioned thereby to extend said determined distance from the lower terminal end of the body, and wherein the stop is in the form of a sleeve slideably engaged over the probe shaft and within the body and with limit means in the form of a pin projecting from the shaft and engaged in a slot in the stop sleeve restricting projection thereof to said extended position.

20. An adjustable pointer for looping yarn in the building of rugs and the like upon backings comprised of a multiplicity of apertures in checkerboard pattern defined by crossed members, and including; an elongated tubular body having a reduced bore at its upper end and open at its lower terminal end, a manually rotatable spindle extending through said bore and with a nut within the body, a probe threadedly engaged in the nut and having a concaved notch at its lower terminal end projecting to extend a determined distance from the lower terminal end of the body by turning said nut, a retractile stop sleeve slideably engaged over the probe and within the body and projected to an extended position determined by a slot of limited length therein engageable over a pin projecting from the probe, spring means engaged with and operable between the stop and a face on said nut to yieldingly urge the stop sleeve to said extended position and permitting retraction thereof, there being a channel extending longitudinally of the stop sleeve bifurcating the same for passing yarn therethrough into engagement with the probe, the bifurcated lower terminal end of the stop sleeve presenting a pair of spaced co-planar shoulders with depending points engageable over a member of the backing to hold the probe against the entry leg of a loop of yarn while the exit leg of said loop is being fully extended.

21. The adjustable rug loop pointer as set forth in claim 20 wherein the points depending from the spaced shoulders are divergent with respect to the projecting probe, whereby the entry leg of yarn is wedged against the probe.

22. The adjustable rug loop pointer as set forth in claim 20 wherein the end portion of the probe turns divergently from the points depending from the spaced shoulders divergently with respect to the projecting probe, whereby the entry leg of yarn is wedged between the points and the probe.

* * * * *